United States Patent [19]

Oshika et al.

[11] 4,452,203

[45] Jun. 5, 1984

[54] THREE POSITION DIESEL ENGINE INTAKE AIR THROTTLING SYSTEM

[75] Inventors: Sumio Oshika; Takahiko Kinoshita, both of Aichi; Nobuhiko Kakeno; Nobuhiro Miura, both of Toyota; Kiyoshi Kato, Anjo; Satosi Kuwakado, Aichi; Yasuo Kondo, Okazaki, all of Japan

[73] Assignees: Toyota Jidosha Kabushiki Kaisha, Toyota; Nippon Soken, Inc., Nishio, both of Japan

[21] Appl. No.: 348,770

[22] Filed: Feb. 16, 1982

[30] Foreign Application Priority Data

Aug. 26, 1981 [JP] Japan ..... 56-134580

[51] Int. Cl.[3] ..... F02D 31/00

[52] U.S. Cl. ..... 123/403; 123/376; 123/395

[58] Field of Search ..... 123/376, 382, 383, 402, 123/403, 395

[56] References Cited

U.S. PATENT DOCUMENTS

| | | | |
|---|---|---|---|
| 3,354,874 | 11/1967 | Dangauthier | 123/382 |
| 3,724,822 | 4/1973 | Nambu et al. | 123/403 |
| 4,058,101 | 11/1977 | Taira et al. | 123/382 |
| 4,060,063 | 11/1977 | Hirasawa | 123/376 |
| 4,117,811 | 10/1978 | Yoshida | 123/403 |
| 4,117,904 | 10/1978 | Matsubara | 123/376 |
| 4,363,303 | 12/1982 | Takayama | 123/376 |

FOREIGN PATENT DOCUMENTS

| | | | |
|---|---|---|---|
| 1017853 | 10/1957 | Fed. Rep. of Germany | 123/403 |
| 2601307 | 7/1977 | Fed. Rep. of Germany | 123/382 |
| 87834 | 7/1980 | Japan | 123/402 |

*Primary Examiner*—Parshotam Lall

*Attorney, Agent, or Firm*—Stevens, Davis, Miller & Mosher

[57] ABSTRACT

An intake air throttling system for a diesel engine comprising an air intake passage. The system includes a throttling valve mounted in the air intake passage so as to selectively throttle air flow through it. This throttling valve can be positioned to at least a first position in which it substantially fully closes the air intake passage, a second position in which it partly throttles the air intake passage to a substantial extent but does not fully close it, and a third position in which it does not throttle the air intake passage to any substantial extent. The throttling valve is controlled by a control system, which positions it to the first position when the engine is being stopped, which positions it to the second position when the engine is being idled, and which positions it to the third position when the engine is being operated in non idling load bearing operational condition. Thereby, when the engine is being stopped, the cutoff of intake air reduces stopping vibration considerably, while when the engine is being idled the partial but substantial throttling of intake air reduces idling vibration and reduces wandering of engine idling speed; and both these effects are accomplished by the use of one throttling valve.

4 Claims, 5 Drawing Figures

THREE POSITION DIESEL ENGINE INTAKE AIR THROTTLING SYSTEM

BACKGROUND OF THE INVENTION

The present invention relates to the general field of diesel internal combustion engines, and more particularly relates to an intake air throttling device for a diesel internal combustion engine which can provide good anti vibration and anti noise protection, both during idling operation and during stopping of the diesel internal combustion engine.

Typically the load on a diesel internal combustion engine, i.e. the power output produced thereby, is regulated by controlling the amount of fuel injected into the combustion chamber or chambers thereof, rather than, as is the case with a gasoline internal combustion engine incorporating a carburetor, by regulating the amount of intake air flow. Thus, when the diesel internal combustion engine is required to produce a considerably high power output, i.e. is required to operate in a medium or a high load operational condition, then a considerable amount of fuel is injected into each combustion chamber thereof at each of its compression strokes; and, on the other hand, when said diesel internal combustion engine is required to produce a low power output just sufficient to keep the engine itself operating, i.e. is required to operate in an idling operational condition, then a much smaller amount of fuel is injected into each combustion chamber thereof at each of its compression strokes.

In a simplest form of conventional prior art, the intake air passage of the diesel engine is left wide open at all times, and therefore enough intake air is available for even high load operation of the engine wherein the pulses of injected diesel fuel which are injected into the combustion chambers are of maximum amount; and, correspondingly, the amount of intake air sucked in to the combustion chambers during idling engine operation wherein the pulses of injected diesel fuel which are injected into the combustion chambers are of quite small amount is very excessive - but this need not present any insuperable problem, although in this case the engine operates in a very over lean operational mode.

However, a problem which often occurs with diesel engines, especially small diesel engines such as are being used more and more these days in automotive applications for passenger cars, is that noise and vibration during engine idling operation are excessive, and can produce user complaints, as well as deteriorating the service lift of such a diesel engine. Accordingly, some means of restricting the idling vibration and noise levels has become a desirable design goal.

In the prior art, a known method of thus improving engine idling operation of a diesel internal combustion engine has been to somewhat throttle the air intake passage of the engine during idling operation thereof, as by using a throttling valve or the like. This has been very useful for reducing noise and vibration during engine idling, and various systems have been proposed for control of such a throttling valve.

Another problem which has been remarked upon with regard to diesel internal combustion engines is that during stopping of the engine, i.e. when during operation of the engine the key switch or the like controlling said engine is switched to the OFF state from the ON state (or the like) and according to this supply of injected pulses of diesel fuel into the combustion chamber or chambers of the diesel engine is terminated, then considerable vibration and noise are liable to be caused. Again, this can produce user complaints, as well as deteriorating the service life of such a diesel engine. Accordingly, again, some means of restricting such stopping vibration and noise levels has become a desirable design goal.

In the prior art, a known method of thus improving engine stopping operation of a diesel internal combustion engine has been to totally close the air intake passage of the diesel internal combustion engine during stopping operation thereof. This is often done in large diesel engines by using a manually controlled throttling valve or the like, and has been very useful for reducing noise and vibration during engine stopping.

Meanwhile, of course if the air intake passage of the diesel internal combustion engine is to be restricted at any time it is important that at no time should the air intake passage be restricted to such an extent as to prevent the entry into the combustion chamber or chambers of the diesel internal combustion engine of sufficient air to completely combust all of the diesel fuel which is being injected into said combustion chamber or chambers. If undesirably the air supply to the combustion chamber or chambers should thus be over restricted, generation of an undesirably large quantity of diesel smoke will most likely occur, as well as the emission in the exhaust gases of the diesel internal combustion engine of an undesirably large quantity of noxious components.

SUMMARY OF THE INVENTION

Accordingly, it is a primary object of the present invention to provide an intake air throttling device for a diesel internal combustion engine, which reduces engine noise during idling operation of said diesel internal combustion engine.

It is a further object of the present invention to provide such an intake air throttling device for a diesel internal combustion engine, which reduces engine vibration during idling operation of said diesel internal combustion engine.

It is a further primary object of the present invention to provide an intake air throttling device for a diesel internal combustion engine, which reduces engine noise during stopping of said diesel internal combustion engine.

It is a further object of the present invention to provide such an intake air throttling device for a diesel internal combustion engine, which reduces engine vibration during stopping of said diesel internal combustion engine.

It is a further object of the present invention to provide such an intake air throttling device for a diesel internal combustion engine, which attains both of the primary objects detailed above with a useful economy of parts, by using some of the same parts for achieving both objects.

It is a further object of the present invention to provide such an intake air throttling device for a diesel internal combustion engine, which runs no risk of unduly throttling the air intake system of the diesel internal combustion engine at any time.

It is a further object of the present invention to provide such an intake air throttling device for a diesel internal combustion engine, which runs no risk of generation of undue quantities of diesel smoke, during engine load bearing operation.

It is a further object of the present invention to provide such an intake air throttling device for a diesel internal combustion engine, which runs no risk of emission of undue quantities of noxious components in the exhaust gases of the diesel internal combustion engine, during engine load bearing operation.

It is a further object of the present invention to provide such an intake air throttling device for a diesel internal combustion engine, which renders the diesel internal combustion engine quiet and comfortable to operate.

It is a yet further object of the present invention to provide such an intake air throttling device for a diesel internal combustion engine, which is of simple construction.

It is a yet further object of the present invention to provide such an intake air throttling device for a diesel internal combustion engine, which is cheap to manufacture.

It is a yet further object of the present invention to provide such an intake air throttling device for a diesel internal combustion engine, which is reliable during use.

It is a yet further object of the present invention to provide such an intake air throttling device for a diesel internal combustion engine, which does not incorporate any complicated control device such as a microcomputer or the like.

It is a yet further object of the present invention to provide such an intake air throttling device for a diesel internal combustion engine, which employs, for sensing the operational condition of the diesel internal combustion engine, a sensor or a combination of sensors or other information providing devices, which are in any event required to be provided to the diesel internal combustion engine for other purposes, thus achieving a useful economy by multiple functioning of said sensors or devices.

According to the present invention, these and other objects are accomplished by an intake air throttling system for a diesel internal combustion engine comprising an air intake passage, comprising: (a) a throttling valve mounted in said air intake passage so as to selectively throttle air flow therethrough, which can be positioned to at least a first position in which it substantially fully closes said air intake passage, a second position in which it partly throttles said air intake passage to a substantial extent but does not fully close said air intake passage, and a third position in which it does not throttle said air intake passage to any substantial extent; and (b) a control system which controls said throttling valve, and: which positions said throttling valve to said first position in which said throttling valve substantially fully closes said air intake passage, when said diesel internal combustion engine is put out of operation from being in operation; which positions said throttling valve to said second position in which said throttling valve partly throttles said air intake passage to a substantial extent but does not fully close said air intake passage, when said diesel internal combustion engine is being operated in idling operational condition; and which positions said throttling valve to said third position in which said throttling valve does not throttle said air intake passage to any substantial extent, when said diesel internal combustion engine is being operated in non idling load bearing operational condition.

According to such a structure, during operation of the diesel internal combustion engine in its non idling load bearing operational condition the throttling valve is positioned by the control system to its said third position in which the air intake passage is not throttled to any substantial extent, and thereby the diesel internal combustion engine is allowed to inhale a proper large quantity of intake air appropriate to such load bearing operation, thus accordingly running no risk of over rich operation of said internal combustion engine. Further, during operation of the diesel internal combustion engine in its idling operational condition, the control system positions said throttling valve to its said second position in which said throttling valve partly throttles the air intake passage to a substantial extent but does not fully close said air intake passage, thus reducing vibration and noise during said engine idling operational condition. Yet further, during stopping of said diesel internal combustion engine, i.e. when said diesel internal combustion engine is put out of operation from being in operation, then the control system positions said throttling valve to said first position in which said throttling valve substantially fully closes said air intake passage, and this reduces the vibration during stopping of the diesel internal combustion engine to a large extent. Both of these beneficial effects are therefore provided by using the same intake throttling valve, which is an admirable economy of construction.

Further, according to a particular aspect of the present invention, these and other objects are more particularly and concretely accomplished by such an intake air throttling system for a diesel internal combustion engine as described above, wherein, when said diesel internal combustion engine transits from the idling non load bearing operational condition to the non idling load bearing operational condition, said control system relatively quickly moves said throttling valve from its said second position in which it partly throttles said air intake passage to a substantial extent but does not fully close said air intake passage to its said third position in which it does not throttle said air intake passage to any substantial extent; but, when said diesel internal combustion engine transits from the non idling load bearing operational condition to the idling non load bearing operational condition, said control system only relatively slowly moves said throttling valve from its said third position in which it does not throttle said air intake passage to any substantial extent to its said second position in which it partly throttles said air intake passage to a substantial extent but does not fully close said air intake passage.

According to such a structure, when said diesel internal combustion engine transits from the non idling load bearing operational condition to the idling non load bearing operational condition, i.e. when a vehicle incorporating said diesel internal combustion engine is decelerated to the idling condition, then because said throttling valve is only relatively slowly moved by said control system from its said third position in which it does not throttle said air intake passage to any substantial extent to its said second position in which it partly throttles said air intake passage to a substantial extent but does not fully close said air intake passage, thereby too rapid applying of said partial throttling action which could undesirably cause a large amount of exhaust smoke and high emission of undesirable components in the exhaust gases of the diesel internal combustion engine is rendered much less likely, due to the gradual applying of said partial throttling action. On the other hand, when said diesel internal combustion engine transits in the reverse sense from the idling non load bearing operational condition to the non idling load bearing operational condition, i.e. when a vehicle incorporating said diesel internal combustion engine is accelerated from the idling condition, then said control system relatively quickly moves said throttling valve from its said second position in which it partly throttles said air intake passage to a substantial extent but does not fully close said air intake passage to its said third position in which it does not throttle said air intake passage to any substantial exten, because at this time rapid supply of high volumes of intake air is appropriate in order to prevent the causing of the generation of a large amount of exhaust smoke and high emission of undesirable components in the exhaust gases of the diesel internal combustion engine.

Further, according to a particular aspect of the present invention, these and other objects are more particularly and concretely accomplished by such an intake air throttling system for a diesel internal combustion engine as described above, said diesel internal combustion engine comprising a key switch which is opened when said diesel internal combustion engine is not to be operated and which is closed when said diesel internal combustion engine is to be operated, and an accelerator linkage which controls the load on said diesel internal combustion engine; further comprising a switching system which is controlled by said accelerator linkage so as to furnish a first electrical signal indicative of whether said diesel internal combustion engine is operating in the idling non load bearing operational condition or in the load bearing non idling operational condition; said control system receiving said first electrical signal and also receiving supply of switched electrical power from said key switch as a second electrical signal, and based upon said first and second electrical signals controlling said throttling valve.

According to such a structure, said control system can easily and reliably be informed as to whether said diesel internal combustion engine is being idled or not, and as to whether said diesel internal combustion engine is being switched off or deactivated or not, according to said first and second electrical signals which come respectively from the aforesaid accelerator pedal switching system and from the aforesaid key switch. Since both the accelerator pedal switching system which detects whether the engine is being idled or not and also the key switch may have other applications in the construction and operation of the diesel internal combustion engine and its associated parts such as a transmission and an electrical system and so on, this makes for a good economy of parts.

Further, according to a particular aspect of the present invention, these and other objects are more particularly and concretely accomplished by such an intake air throttling system for a diesel internal combustion engine as proximately described above, wherein said control system comprises a double action diaphragm actuator which comprises a first and a second diaphragm chamber, a first electromagnetic pressure switching valve, and a second electromagnetic pressure switching valve; said double action diaphragm actuator positioning said throttling valve to its said first position in which it substantially fully closes said air intake passage, or its said second position in which it partly throttles said air intake passage to a substantial extent but does not fully close said air intake passage, or its said third position in which it does not throttle said air intake passage to any substantial extent, according to different combinations of supply of atmospheric pressure or vacuum to said first and second diaphragm chambers; selective supply of atmospheric pressure or vacuum to said first diaphragm chamber being controlled by said first electromagnetic pressure switching valve which is controlled based upon said first electrical signal, and selective supply of atmospheric pressure or vacuum to said second diaphragm chamber being controlled by said second electromagnetic pressure switching valve which is controlled based upon said second electrical signal; and wherein further said double action diaphragm actuator positions said throttling valve to its said first position in which it substantially fully closes said air intake passage when both said first diaphragm chamber is supplied with vacuum and also said second diaphragm chamber is supplied with vacuum; wherein said double action diaphragm actuator positions said throttling valve to its said second position in which it partly throttles said air intake passage to a substantial extent but does not fully close said air intake passage when said first diaphragm chamber is supplied with vacuum but when said second diaphragm chamber is not supplied with vacuum but is supplied with atmospheric air; and wherein said double action diaphragm actuator positions said throttling valve to its said third position in which it does not throttle said air intake passage to any substantial extent when when both said first diaphragm chamber is not supplied with vacuum but is supplied with atmospheric air and also said second diaphragm chamber is not supplied with vacuum but is supplied with atmospheric air.

According to such a structure, the control system may be of a simple and reliable construction, not necessarily incorporating any such device as a microcomputer or the like, and the throttling valve may be moved to and fro between its said first, second, and third positions so as to selectively throttle the intake passage of the diesel internal combustion engine by a reliable device such as the aforesaid diaphragm actuator, which is supplied with actuating vacuum by reliable and cheap devices such as the aforesaid first and second electromagnetic pressure switching valves.

Further, according to a yet more particular aspect of the present invention, these and other objects are more particularly and concretely accomplished by such an intake air throttling system for a diesel internal combustion engine as described above, further comprising a one way pressure transmission delay valve which is interposed between said first electromagnetic pressure switching valve and said first diaphragm chamber, and which permits the quick transmission of atmospheric air from said first electromagnetic pressure switching valve to said first diaphragm chamber, but which only permits the relatively slow transmission of vacuum from said first electromagnetic pressure switching valve to said first diaphragm chamber.

According to such a structure, the provision of this one way pressure transmission delay valve effectively implements the abovementioned desirable feature of the present invention of providing a somewhat delayed motion of the throttling valve, when said diesel internal combustion engine transits from the non idling load bearing operational condition to the idling non load bearing operational condition, i.e. when a vehicle incorporating said diesel internal combustion engine is decelerated to the idling condition, from its said third position in which it does not throttle said air intake passage to any substantial extent to its said second position in which it partly throttles said air intake passage to a substantial extent but does not fully close said air intake passage. This delayed motion is provided because of the length of time that it takes for air to pass through said one way pressure transmission delay valve from said first electromagnetic pressure switching valve to said first diaphragm chamber. The one way pressure transmission valve further is required to be a one way valve, in order to allow the aforesaid desirable quick motion of the throttling valve, when said diesel internal combustion engine transits from the idling non load bearing operational condition to the non idling load bearing operational condition, i.e. when a vehicle incorporating said diesel internal combustion engine is accelerated from the idling condition, from its said second position in which it partly throttles said air intake passage to a substantial extent but does not fully close said air intake passage to its said third position in which it does not throttle said air intake passage to any substantial extent.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
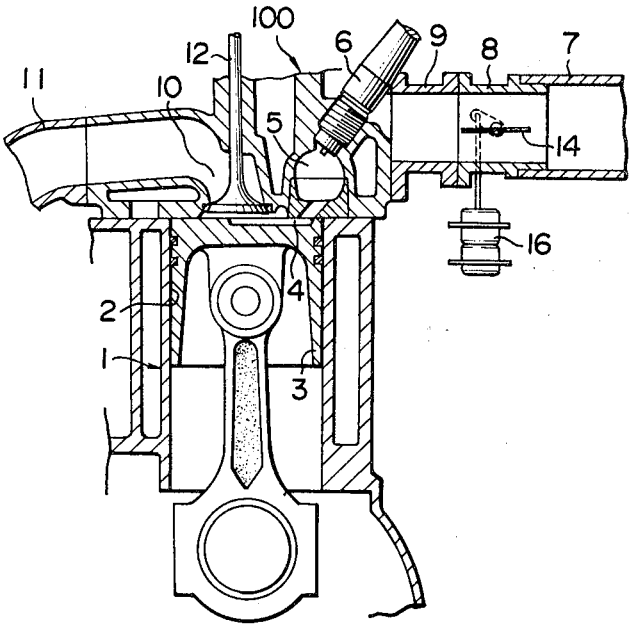
FIG. 1 is a sectional view of part of a diesel engine which is equipped with said preferred embodiment of the diesel engine intake air throttling system according to the present invention.

The present invention will now be described with reference to a preferred embodiment thereof, and with reference to the appended drawings. FIG. 1 is a sectional view through a diesel internal combustion engine, designated generally by the reference numeral 1, which is equipped with said preferred embodiment of the diesel engine intake air throttling system according to the present invention, taken along the central axis of a cylinder bore 2 thereof.

A piston 3 reciprocates slidingly up and down in the figure in said cylinder bore 2, and above said piston 3 there is defined a combustion chamber 4 by said piston in cooperation with a cylinder head 100. In said cylinder head 100 there is formed a vortex chamber 5 which communicates to said combustion chamber 4, and in said vortex chamber 5 there is fitted a fuel injector 6. Intake air is supplied to said combustion chamber 4 through, in order from the atmosphere, an air intake tube 7, a valve housing 8 the function of which will be more particularly described later, an intake manifold 9 which is fixed to the outer surface of said cylinder head 100, and an intake port which is not shown in the figure because in fact it lies behind the fuel injector 6 and the vortex chamber 5, said intake port being controlled by an intake poppet valve which is not shown in the figure either, for the same reason. After this intake air has been mixed with diesel fuel injected through the fuel injector 6, and combustion has occurred in the combustion chamber 4, then the exhaust gases resulting from said combustion are exhausted from said combustion chamber 4 through an exhaust port 10 which is controlled by an exhaust poppet valve 12, and are vented through an exhaust manifold 11 which is also fixed to the outer surface of the cylinder head 100. This arrangement, with the exception of the interposition of the valve housing 8 in the intake air path as it passes into the combustion chamber 4, is per se well known and conventional.

Figure 2:
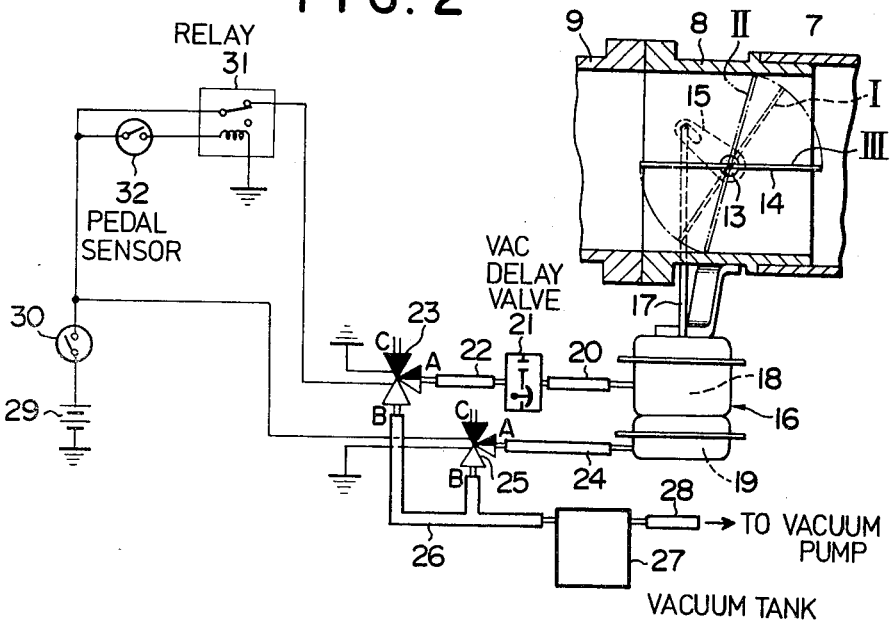
FIG. 2 is a partly schematic view of said preferred embodiment of the diesel engine intake air throttling system according to the present invention, also showing a battery and a key switch for the diesel engine shown in FIG. 1, and showing in section part of the intake passage of said diesel engine.

In FIG. 2 the valve housing 8 can be seen in sectional view in more detail. This valve housing 8 is formed as a tube, and within the tubular interior thereof there is mounted a per se conventional butterfly valve 14. This butterfly valve 14 is fixed to a valve shaft 13 which is pivotally mounted across the center of the valve housing 8. The butterfly valve 14 can move to any position in the range between two extreme positions: a position shown by solid lines in the figure and denoted by "III", in which said butterfly valve 14 is fully open and does not significantly obstruct the passage of intake air through the tubular hole through the valve housing 8, and a position shown by double dotted lines in the figure and denoted by "II", in which said butterfly valve 14 is fully closed, and does not significantly allow the passage of any intake air through the tubular hole through the valve housing 8, totally blocking said tubular hole; and, in particular, said butterfly valve 14 can be positioned to an intermediate position between its said fully open position III and its said fully closed position II said position being shown by dashed lines in the figure and denoted by "I", in which said butterfly valve 14 is partly closed, and somewhat obstructs the passage of intake air through the tubular hole through the valve housing 8, without totally blocking said passage of intake air.

An end of the valve shaft 13 which projects to the outside of the valve housing 8 (although this detail cannot be seen in the figures) is fixedly coupled to the one end of a valve actuating lever 15, the other end of which is drivingly pivotally (and slidingly) coupled to the upper end in FIG. 2 of a valve actuating rod 17. The lower end of the valve actuating rod 17 extends into and is driven by a double action diaphragm device 16.

The double action diaphragm device 16 is of a per se well known sort, and has two diaphragm chambers, denoted in FIG. 2 by 18 and 19 respectively. The function of this diaphragm device 16 is as follows. When no negative pressure is introduced either into the first diaphragm chamber 18 or into the second diaphragm chamber 19 of the double action diaphragm device 16, then the valve rod 17 is so positioned thereby as to position the butterfly valve 14 to its said fully open position denoted by III in the figure and shown by solid lines, wherein it is fully open and does not significantly obstruct the passage of intake air through the tubular hole through the valve housing 8; when negative pressure is introduced into the first diaphragm chamber 18 of the double action diaphragm device 16, but no negative pressure is introduced into the second diaphragm chamber 19, then the valve rod 17 is so positioned thereby as to position the butterfly valve 14 to its said partly open position denoted by I in the figure and shown by dashed lines, wherein it is partly closed and somewhat obstructs the passage of intake air through the tubular hole through the valve housing 8 without totally blocking said passage of intake air; when negative pressure is introduced both into the first diaphragm chamber 18 and into the second diaphragm chamber 19 of the double action diaphragm device 16, then the valve rod 17 is so positioned thereby as to position the butterfly valve 14 to its said fully closed position denoted by II in the figure and shown by double dashed lines, wherein it is fully closed and does not significantly allow the passage of any intake air through the tubular hole through the valve housing 8, totally blocking said tubular hole; and the action when no negative pressure is introduced into the first diaphragm chamber 18 of the double action diaphragm device 16, but negative pressure is introduced into the second diaphragm chamber 19, need not be considered, since as will be seen later this state of affairs never occurs during the functioning of the shown preferred embodiment of the diesel engine intake air throttling system according to the present invention.

Now, the arrangements for selectively supplying actuating negative pressure to the first and second diaphragm chambers 18 and 19 will be explained.

A first electromagnetic vacuum switching valve and a second electromagnetic vacuum switching valve are provided, respectively for controlling supply of negative pressure to the first and the second diaphragm chambers 18 and 19, and these are denoted in FIG. 2 by the reference numerals 23 and 25 respectively. Each of these electromagnetic vacuum switching valves 23 and 25 is formed with three ports, denoted in the figure by "A", "B", and "C", and may comprise an electromagnetic coil, a solenoid element, and so forth, or may be formed in some other per se well known fashion. The functioning of each of these electromagnetic vacuum switching valves 23 and 25 is as follows: when it is not supplied with actuating electrical energy, then its ports A and B are communicated together, while its port C is not communicated to any other port; and, when it is supplied with actuating electrical energy, then its ports A and C are communicated together, while its port B is not communicated to any other port.

The ports C of both the first electromagnetic vacuum switching valve 23 and the second electromagnetic vacuum switching valve 25 are communicated to supply of air at atmospheric pressure. The ports B of both the first electromagnetic vacuum switching valve 23 and the second electromagnetic vacuum switching valve 25 are communicated to a vacuum storage tank 27 via a negative pressure conduit system 26. The vacuum storage tank 27, during normal operation of the diesel internal combustion engine 1, is kept filled with negative pressure (i.e. is exhausted to some extent of air) by a vacuum pump not shown in the figure which is operated from said diesel internal combustion engine 1, via a negative pressure conduit 28. Thus, during normal operation of the diesel internal combustion engine 1, the ports B of both the first electromagnetic vacuum switching valve 23 and the second electromagnetic vacuum switching valve 25 are continually supplied with a constant supply of negative pressure stored in said vacuum storage tank 27. Finally, the port A of the first electromagnetic vacuum switching valve 23 is communicated to the input port of the first diaphragm chamber 18 of the double action diaphragm device 16 via, in order, a negative pressure conduit 22, a negative pressure one way delay valve 21, and another negative pressure conduit 20, while the port A of the second electromagnetic vacuum switching valve 25 is communicated to the input port of the second diaphragm chamber 19 of the double action diaphragm device 16 via a negative pressure conduit 24. The negative pressure one way delay valve 21 is so constructed that it allows flow of negative pressure substantially freely in the right to left direction in the figure, i.e. it allows flow of negative pressure without offering any substantial interruption thereto from its port connected to the negative pressure conduit 20 to its port connected to the negative pressure conduit 22 - or in other words it allows flow of air substantially freely in the left to right direction in the figure, i.e. it allows flow of negative pressure without offering any substantial interruption thereto from its port connected to the negative pressure conduit 22 to its port connected to the negative pressure conduit 20; while on the other hand it only allows flow of negative pressure in the left to right direction in the figure, i.e. it only allows flow of negative pressure from its port connected to the negative pressure conduit 22 to its port connected to the negative pressure conduit 20, rather slowly with a certain delay time - or in other words it only allows flow of air in the right to left direction in the figure, i.e. it only allows flow of air from its port connected to the negative pressure conduit 20 to its port connected to the negative pressure conduit 22, rather slowly with a certain delay time. This negative pressure one way delay valve 21 may be constructed, as suggested in the figure, by combining a throttling orifice and a one way air valve.

The diesel internal combustion engine 1 is provided with a battery 29 which supplies electrical power to one side of a key switch 30. When the diesel internal combustion engine 1 is to be operated, the key switch 30 is turned to the ON condition; but, when the diesel internal combustion engine 1 is to be not operated, the key switch 30 is turned to the OFF condition. Electrical power taken from the other side of the key switch 30, as well of course as being used for other purposes to do with the diesel internal combustion engine 1, is fed directly to the coil or the like of the second electromagnetic vacuum switching valve 25 as a selective supply of actuating electrical energy, the other side of said coil or the like being connected to ground. Further, said electrical power taken from said other side of the key switch 30 is also fed both to one side of an accelerator pedal sensor switch 32, the other side of said accelerator pedal sensor switch 32 being connected through the electromagnetic coil of a relay 31 to ground, and to a switched input terminal of said relay 31, the switched output terminal of said relay 31 being connected directly to the coil or the like of the electromagnetic vacuum switching valve 23 so as to provide selective supply of actuating electrical energy thereto, the other side of said coil or the like being connected to ground. The accelerator pedal sensor switch 32 is so constructed and is so fitted to the linkage which leads from the accelerator pedal to control the diesel internal combustion engine 1 that said accelerator pedal switch is opened when said accelerator pedal is even slightly depressed by the foot of an engine operator, but is closed when said accelerator pedal is not so depressed at all. And the relay 31 is so constructed that the switched terminals thereof are communicated together when the electromagnetic coil thereof is not supplied with actuating electrical energy, but so that the switched terminals thereof are discommunicated from one another when the electromagnetic coil thereof is supplied with actuating electrical energy.

Thus, the second electromagnetic vacuum switching valve 25 is supplied with actuating electrical energy when and only when the key switch 30 is closed; while the first electromagnetic vacuum switching valve 23 is supplied with actuating electrical energy when and only when the key switch 30 is closed and in addition the accelerator pedal sensor switch 32 is open - i.e., when and only when the key switch 30 is closed and in addition the accelerator pedal which controls the diesel internal combustion engine 1 is at least slightly depressed by the foot of an engine operator.

By the way, the reason for the provision of the accelerator pedal sensor switch 32 as a switch which is closed when and only when the accelerator pedal is not depressed at all, and for the provision of the relay 31, rather than some reversed or simpler construction, is because in fact, although it is not so shown in the figure, this accelerator pedal sensor switch 32 may also be put to other uses in the operation of the diesel internal combustion engine 1 or of devices associated therewith in the vehicle in which it is fitted, such as a transmission, an electrical system, or the like.

Now, the operation of the shown preferred embodiment of the diesel engine intake air throttling system according to the present invention shown in FIGS. 1 and 2 will be explained.

First, when the diesel internal combustion engine 1 is operating in the non idling or load bearing engine operational condition, i.e. when said diesel internal combustion engine 1 is operating with the accelerator pedal which controls it at least somewhat depressed, then the accelerator pedal sensor switch 32 is open, and thus the switched terminals of the relay 31 are closed, and also of course the key switch 30 is closed, and thus both the first electromagnetic vacuum switching valve 23 and also the second electromagnetic vacuum switching valve 25 are supplied with actuating electrical energy. Accordingly, the switched port A of the first electromagnetic vacuum switching valve 23 is communicated to the atmospheric air port C thereof, and also the switched port A of the second electromagnetic vacuum switching valve 25 is communicated to the atmospheric air port C thereof, while the B ports of these valves are not communicated to any other ports. Therefore, both the first diaphragm chamber 18 of the double action diaphragm device 16 and also the second diaphragm chamber 19 thereof are supplied with air at atmospheric pressure, and accordingly as explained above the butterfly valve 14 is positioned by the action of said double action diaphragm device 16, via the valve actuating rod 17, the valve actuating lever 15, and the valve shaft 13 to its said fully open position denoted by III in FIG. 2 and shown by solid lines, wherein it is fully open and does not significantly obstruct the passage of intake air through the tubular hole through the valve housing 8. Thus, in this operational state, the diesel internal combustion engine 1 functions with no substantial obstacle being provided to the flow of intake air into its combustion chambers, which is appropriate for this current load bearing operational condition in which said diesel internal combustion engine 1 is operating with the accelerator pedal which controls it at least somewhat depressed.

However, when the diesel internal combustion engine 1 is operating in the idling or no load engine operational condition, i.e. when said diesel internal combustion engine 1 is operating with the accelerator pedal which controls it not even somewhat depressed, then the accelerator pedal sensor switch 32 is closed, and thus the switched terminals of the relay 31 are open, and also of course the key switch 30 is closed, and thus the first electromagnetic vacuum switching valve 23 is not supplied with actuating electrical energy, while on the other hand the second electromagnetic vacuum switching valve 25 is supplied with actuating electrical energy. Accordingly, the switched port A of the first electromagnetic vacuum switching valve 23 is communicated to the vacuum port B thereof, while the atmospheric port C of this first electromagnetic vacuum switching valve 23 is not communicated to any other port; and, on the other hand, the switched port A of the second electromagnetic vacuum switching valve 25 is communicated to the atmospheric air port C thereof, while the vacuum port B of this second electromagnetic vacuum switching valve 25 is not communicated to any other port. Therefore, the first diaphragm chamber 18 of the double action diaphragm device 16 is supplied with negative pressure (i.e., vacuum) which is stored up in the vacuum accumulation tank 27, via the conduit system 26, while on the other hand the second diaphragm chamber 19 of said double action diaphragm device 16 is supplied with air at atmospheric pressure, and accordingly as explained above the butterfly valve 14 is positioned by the action of said double action diaphragm device 16, via the valve actuating rod 17, the valve actuating lever 15, and the valve shaft 13 to its said partly open position denoted by I in FIG. 2 and shown by dashed lines, wherein it is partly closed and somewhat obstructs the passage of intake air through the tubular hole through the valve housing 8 without totally blocking said passage of intake air. Thus, in this operational state, the diesel internal combustion engine 1 functions with a considerable throttling action being provided to the flow of intake air into its combustion chambers, which is appropriate for this current idling non load bearing operational condition in which said diesel internal combustion engine 1 is operating with the accelerator pedal which controls it not even somewhat depressed. That is to say, by the provision of this certain degree of intake passage throttling action, drivability of the vehicle in idling condition is improved, and vibration and noise during idling are also substantially reduced. Further, as will be seen later, the wandering of the idling rotational speed of the diesel internal combustion engine 1, i.e. the percentage amount of change in its idling rotational speed which it is liable to suffer during a period of idling, is much reduced as compared with the case in which no intake throttling effect is provided for the intake air which is entering into the combustion chambers thereof.

In this connection, during the transition from the above described non idling or load bearing engine operational condition to the above described idling or no load engine operational condition, i.e. during deceleration of the diesel internal combustion engine 1, then when the accelerator pedal which controls the engine 1 is for example suddenly released and supply of electrical energy suddenly stops being made to the first electromagnetic vacuum switching valve 23 (while on the other hand the second electromagnetic vacuum switching valve 25 continues to be supplied with actuating electrical energy), and when thus the switched port A of said first electromagnetic vacuum switching valve 23 comes suddenly to be communicated with the vacuum port B of said first electromagnetic vacuum switching valve 23 from being communicated with the atmospheric port C thereof, and therefore when said switched port A comes suddenly to be supplied with negative pressure which is as mentioned above present at said vacuum port B of said first electromagnetic vacuum switching valve 23 as supplied from said negative pressure accumulation tank 27, then if the negative pressure one way delay valve 21 were not provided there would be a danger that this negative pressure now suddenly coming to be present at said switched port A of said first electromagnetic vacuum switching valve 23 would be immediately transmitted to the first diaphragm chamber 18 of the double action diaphragm device 16, and this would immediately and suddenly, as explained above, cause said double action diaphragm device 16 to position the butterfly valve 14, via the valve actuating rod 17, the valve actuating lever 15, and the valve shaft 13, to its said partly open position denoted by I in FIG. 2 and shown by dashed lines, wherein it is partly closed and somewhat obstructs the passage of intake air through the tubular hole through the valve housing 8 without totally blocking said passage of intake air. This would cause sudden excessive negative pressure to be produced in the intake passage downstream of said butterfly valve 14, which might well reduce the drivability of a vehicle incorporating the diesel internal combustion engine 1 at this time, and which accordingly is most undesirable. In other words, although in the steadily idling operational state the diesel internal combustion engine 1 will best function with a considerable throttling action being provided to the flow of intake air into its combustion chambers, as is appropriate for this idling non load bearing operational condition in which said diesel internal combustion engine 1 is operating with the accelerator pedal which controls it not even somewhat depressed, it is desirable not to apply this considerable throttling effect very suddenly when the engine is first to be put into the idling operational state, but rather to apply said considerable throttling effect quite gradually. This in fact is because, when the accelerator pedal which controls said diesel internal combustion engine 1 is suddently released, for a certain time the crankshaft or the like of said diesel internal combustion engine 1 will continue to rotate at a high rotational speed much above the idling rotational speed, at which high engine crankshaft rotational speed engine operational condition the provision of substantial intake system throttling action such as by the butterfly valve 14 is inappropriate; and only after a certain time will the rotational speed of said crankshaft of said diesel internal combustion engine 1 reach its idling rotational speed, at which idling rotational speed operational condition the provision of substantial intake system throttling action such as by the butterfly valve 14 is appropriate.

Accordingly, in order to prevent this difficulty, the negative pressure one way delay valve 21 is provided between the switched port A of the first electromagnetic vacuum switching valve 23 and the first diaphragm chamber 18 of the double action diaphragm actuator 16. Accordingly, when as described above during engine deceleration when the accelerator pedal which controls the diesel internal combustion engine 1 is suddenly released, and accordingly suddenly said switched port A of said first electromagnetic vacuum switching valve 23 is communicated to the vacuum port B thereof, the vacuum which thereby suddenly becomes present at said switched port A is not immediately transmitted to said first diaphragm chamber 18 of the double action diaphragm actuator 16, but rather said vacuum is gradually transmitted to said first diaphragm chamber 18, via said negative pressure one way delay valve 21. This prevents excessively high intake vacuum being produced in the intake passage downstream of said butterfly valve 14, and accordingly helps to promote the drivability of a vehicle incorporating the diesel internal combustion engine 1 at this time.

However, during the reverse transition to the above mentioned transition, i.e. during the transition from the above described non idling or load bearing engine operational condition to the above described idling or no load engine operational condition, at this time, i.e. during acceleration of the diesel internal combustion engine 1, then when the accelerator pedal which controls the engine 1 is for example suddenly depressed and supply of electrical energy suddenly starts to be made to the first electromagnetic vacuum switching valve 23 (while on the other hand the second electromagnetic vacuum switching valve 25 continues to be supplied with actuating electrical energy), and when thus the switched port A of said first electromagnetic vacuum switching valve 23 comes suddenly to be communicated with the atmospheric port C of said first electromagnetic vacuum switching valve 23 from being communicated with the vacuum port B thereof, and therefore when said switched port A comes suddenly to be no longer supplied with negative pressure which is as mentioned above present at said vacuum port B of said first electromagnetic vacuum switching valve 23 as supplied from said negative pressure accumulation tank 27, but instead is suddenly supplied with atmospheric pressure which is present at said atmospheric port C, then it is in fact desirable that immediately the butterfly valve 14 should move to its its said fully open position denoted by III in the figure and shown by solid lines, wherein it is fully open and does not significantly obstruct the passage of intake air through the tubular hole through the valve housing 8, in order for the diesel internal combustion engine 1 to receive a good supply of intake air for acceleration purposes. Accordingly, because the negative pressure one way delay valve 21 functions, as far as its delaying action is concerned, in one direction only, thus this atmospheric pressure now suddenly coming to be present at said switched port A of said first electromagnetic vacuum switching valve 23 is in fact as desirable immediately transmitted to the first diaphragm chamber 18 of the double action diaphragm device 16, and this immediately and suddenly causes said double action diaphragm device 16 to position the butterfly valve 14, via the valve actuating rod 17, the valve actuating lever 15, and the valve shaft 13, to its said said fully open position denoted by III in the figure and shown by solid lines, wherein it is fully open and does not significantly obstruct the passage of intake air through the tubular hole through the valve housing 8. Thus, the production of diesel smoke during acceleration of the vehicle incorporating the diesel internal combustion engine 1, due to shortage of intake air upon such acceleration, is prevented, although of course in line with the sudden depressing of the accelerator pedal which controls said diesel internal combustion engine 1 the amount of fuel supplied through the injectors thereof such as the injector 6 increases greatly.

In other words, in the load bearing operational state the diesel internal combustion engine 1 will best function with no considerable throttling action being provided to the flow of intake air into its combustion chambers, as is appropriate for this load bearing operational condition in which said diesel internal combustion engine 1 is operating with the accelerator pedal which controls it at least somewhat depressed, and it is desirable to remove the considerable throttling effect which was being provided in the engine idling operational condition quite suddenly when the engine is first to be put into the non idling or load bearing operational state, and not to remove said considerable throttling effect quite gradually. Accordingly, in order to provide this immediate transmission effect, the negative pressure one way delay valve 21 provided between the switched port A of the first electromagnetic vacuum switching valve 23 and the first diaphragm chamber 18 of the double action diaphragm actuator 16 is arranged to function as far as its delay action is concerned in one direction only. Accordingly, when as described above during engine acceleration when the accelerator pedal which controls the diesel internal combustion engine 1 is suddenly depressed, and accordingly suddenly said switched port A of said first electromagnetic vacuum switching valve 23 is communicated to the atmospheric port C thereof, the atmospheric pressure which thereby suddenly becomes present at said switched port A is immediately transmitted to said first diaphragm chamber 18 of the double action diaphragm actuator 16, via said negative pressure one way delay valve 21. This prevents smoke being generated due to lack of sufficient intake air during acceleration, and accordingly helps to promote the environmental acceptability of a vehicle incorporating the diesel internal combustion engine 1 at this time. The occurrence of diesel smoke is one of the principal problems confronting the acceptance of diesel engines in automotive vehicles, especially passenger cars, and accordingly smoke reduction is a highly desirable aim in the design of diesel engines.

Now, when from either of the above described engine operational conditions, i.e. either from the above described non idling or load bearing engine operational condition or from the above described idling or no load engine operational condition, the key switch 30 is opened so as to cease engine operation, then, irrespective of whether or not the accelerator pedal sensor switch 32 is open and of whether or not the switched terminals of the relay 31 are closed, both the first electromagnetic vacuum switching valve 23 and also the second electromagnetic vacuum switching valve 25 immediately and suddenly come not to be supplied with actuating electrical energy. Accordingly, the switched port A of the first electromagnetic vacuum switching valve 23 comes to be suddenly communicated to the vacuum port B thereof, and also the switched port A of the second electromagnetic vacuum switching valve 25 comes to be suddenly communicated to the vacuum air port B thereof, while the atmospheric air ports C of these valves come suddenly not to be communicated to any other ports. Therefore, both the first diaphragm chamber 18 of the double action diaphragm device 16 and also the second diaphragm chamber 19 thereof are supplied with negative pressure, although as explained above this negative pressure takes a little time to be transmitted to the first diaphragm chamber 18, if in fact the diesel internal combustion engine 1 was deactivated by switching off the key switch 30 from the non idling engine operational condition. In any event, when said negative pressure has been communicated to both the first diaphragm chamber 18 of the double action diaphragm device 16 and also the second diaphragm chamber 19 thereof, as explained above the butterfly valve 14 is positioned by the action of said double action diaphragm device 16, via the valve actuating rod 17, the valve actuating lever 15, and the valve shaft 13 to its said fully closed position denoted by II in the figure and shown by double dashed lines, wherein it is fully closed and does not significantly allow the passage of any intake air through the tubular hole through the valve housing 8, totally blocking said tubular hole. Thus, in this operational state, the diesel internal combustion engine 1 is not able to operate, because no substantial supply of intake air into the combustion chambers thereof is allowed, due to the closing of said butterfly valve 14. As previously mentioned and as will be seen hereinafter, this considerably reduces engine vibration and shutter when stopping the engine, and accordingly is highly advantageous.

Finally, if from the non engine operating engine condition it is desired to start the diesel internal combustion engine 1, then of course the key switch 30 is first turned on, and then the engine 1 is cranked to start it. As soon as the key switch 30 is turned on, the second electromagnetic vacuum switching valve 25 is supplied with actuating electrical energy. Accordingly, the switched port A of the second electromagnetic vacuum switching valve 25 is communicated to the atmospheric air port C thereof, while the vacuum port B of this valve is not communicated to any other port. Therefore, at least the second diaphragm chamber 19 of the double action diaphragm device 16 supplied with air at atmospheric pressure, and accordingly as explained above the butterfly valve 14 is at least positioned to its said partly open position denoted by I in the figure and shown by dashed lines, wherein it is only partly closed and only somewhat obstructs the passage of intake air through the tubular hole through the valve housing 8 without totally blocking said passage of intake air. In fact, either if the supply of negative pressure from the negative pressure accumulation tank 27 is inadequate or effectively non existent at this time, or if the accelerator pedal which controls the diesel internal combustion engine 1 is even slightly depressed (either due to depression by the operator of the engine or because the fuel amount is increased due to cold starting conditions) thus opening the accelerator pedal sensor switch 32 and thus connecting together the switched terminals of the relay 31 and supplying the second electromagnetic vacuum switching valve 25 with actuating electrical energy thus communicating the switched port A thereof with the atmospheric port C thereof, then also the first diaphragm chamber 19 of the double action diaphragm device 16 will be supplied with air at atmospheric pressure, and accordingly as explained above the butterfly valve 14 will in fact be positioned to its said fully open position denoted by III in the figure and shown by solid lines, wherein it is fully open and does not significantly obstruct the passage of intake air through the tubular hole through the valve housing 8. In either case, quite sufficient intake air will be available for starting of the diesel internal combustion engine 1 at this time; the amount of throttling action that will be present if in fact the butterfly valve 14 is positioned to its said partly open position denoted by I in the figure and shown by dashed lines will not cause any significant problems with regard to starting said diesel internal combustion engine 1, because the revolution speed of the crankshaft of a diesel internal combustion engine during starting thereof is naturally low, and therefore the flow of intake air through the intake system during starting is also relatively low, and accordingly no substantial negative pressure will be generated in the intake passage downstream of the butterfly valve 14 at this time, even if said butterfly valve 14 is partly closed.

Figure 3:
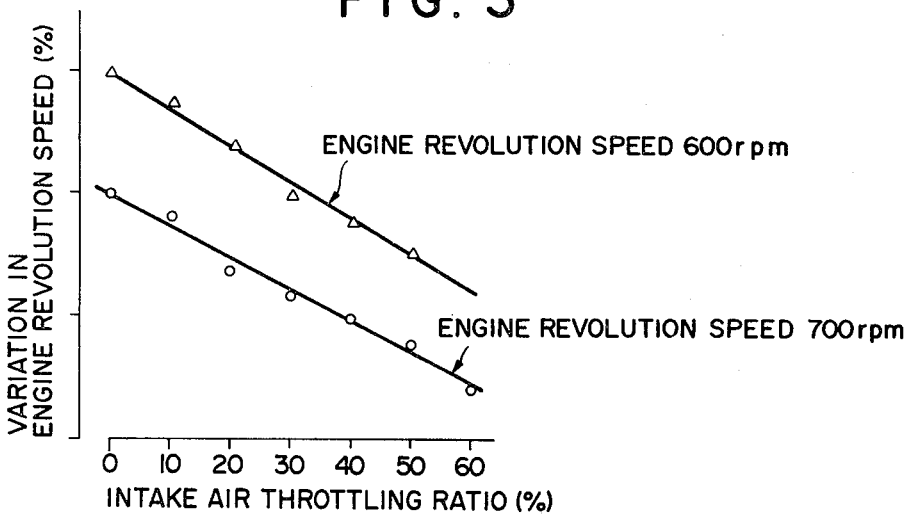
FIG. 3 is a graph, in which percentage engine intake air throttling ratio is the abscissa and percentage variation in engine revolution speed is the ordinate, showing the performance of a diesel engine equipped with said preferred embodiment of the diesel engine intake air throttling system according to the present invention with regard to variation of idling engine revolution speed, both at an average idling speed of 600 rpm, and at an average idling speed of 700 rpm.

In FIG. 3, which is a graph in which percentage engine intake air throttling ratio is the abscissa and percentage variation in engine idling revolution speed is the ordinate, showing the performance of a diesel engine equipped with said preferred embodiment of the diesel engine intake air throttling system according to the present invention with regard to variation of idling engine revolution speed, it can be seen that the percentage variation in engine revolution speed during idling operational condition reduces steadily, the higher is the percentage engine intake air throttling ratio. However, it should be noted that if the percentage engine intake air throttling ratio is too high, then bad fuel economy and engine smoke will occur, and this causes excess pollution; therefore, it is desirable from this point of view to keep the percentage engine intake air throttling ratio between about 10% and about 30%. In FIG. 3, the upper line relates to idling operational condition at 600 rpm of the diesel internal combustion engine, and the lower line relates to idling operational condition at 700 rpm thereof. The lines shown in the graph of FIG. 3 have been determined by a process of experiment.

Figure 4:
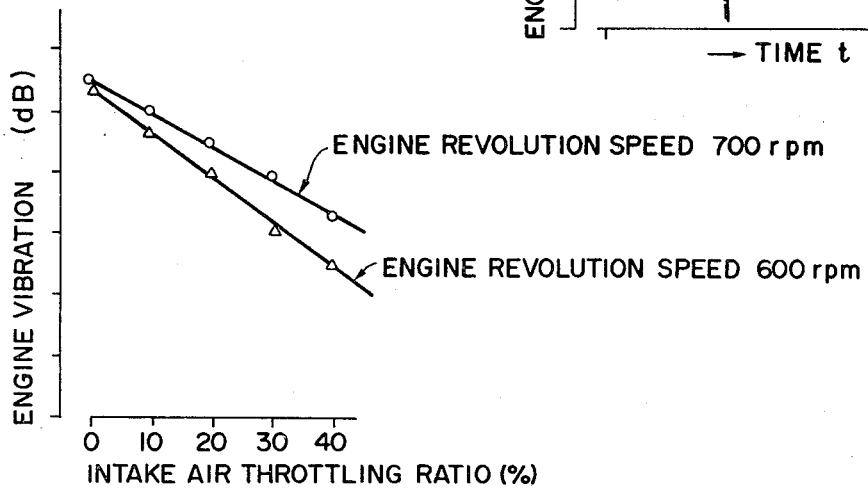
FIG. 4 is a graph, in which percentage engine intake air throttling ratio is the abscissa and engine idling vibration is the ordinate, showing the performance of a diesel engine equipped with said preferred embodiment of the diesel engine intake air throttling system according to the present invention with regard to idling engine vibration, both at an average idling speed of 600 rpm, and at an average idling speed of 700 rpm.

In FIG. 4, which is a graph in which percentage engine intake air throttling ratio is the abscissa and engine idling vibration is the ordinate, showing the performance of a diesel engine equipped with said preferred embodiment of the diesel engine intake air throttling system according to the present invention with regard to idling engine vibration, it can be seen that the engine vibration during idling operational condition reduces steadily, the higher is the percentage engine intake air throttling ratio. However, for the reasons outlined above it is desirable to keep the percentage engine intake air throttling ratio between about 10% and about 30%. In FIG. 4, the upper line relates to idling operational condition at 700 rpm of the diesel internal combustion engine, and the lower line relates to idling operational condition at 600 rpm thereof. The lines shown in the graph of FIG. 4, again, have been determined by a process of experiment.

Figure 5:
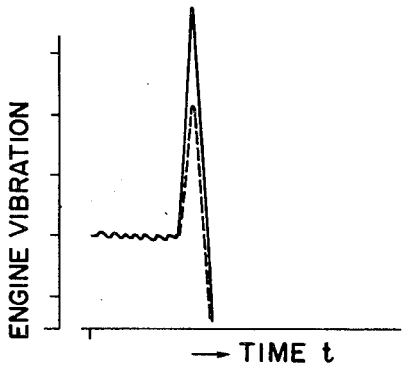
FIG. 5 is a graph, in which time is the abscissa, and engine vibration is the ordinate, showing the performance of a diesel engine equipped with said preferred embodiment of the diesel engine intake air throttling system according to the present invention with regard to engine vibration when the engine has been switched off and while its rotation is stopping, as contrasted to the performance of a diesel engine which is not equipped with any such intake air throttling system.

In FIG. 5, which is a graph in which time is the abscissa, and engine vibration is the ordinate, showing by the dashed line the performance of a diesel engine equipped with said preferred embodiment of the diesel engine intake air throttling system according to the present invention with regard to engine vibration when the engine has been switched off and while its rotation is stopping, in which stopping the butterfly valve 14 is as described above completely closed, as contrasted to the performance, shown by the solid line, of a diesel engine which is not equipped with any such intake air throttling system, in which stopping the engine intake air is not particularly throttled, it can be seen that generally according to the present invention the engine vibrates much less while stopping, and also that the peak of engine vibration when stopping is very significantly reduced. Thus drivability and comfort for the driver during operation of a vehicle incorporating said diesel engine are much improved, according to the present invention.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. An intake air throttling system for a diesel internal combustion engine comprising an electrical switch which is opened when said engine is not to be operated and which is closed when said engine is to be operated, an accelerator pedal which controls the load on said engine, and an air intake passage, comprising:

a throttling valve mounted in said air intake passage so as to be movable from a first position in which it substantially fully closes said air intake passage, through a second position in which it partly throttles said air intake passage, up to a third position in which it substantially fully opens said intake passage; and a control system for controlling said throttling valve so as to position said throttling valve to said first position when said engine is put out of operation from being in operation, to said second position when said engine is being operated in idling operational condition, and to said third position when said engine is being operated in non-idling load bearing operational condition, said control system comprising a double action diaphragm actuator which comprises a first and a second diaphragm chamber, a first electromagnetic pressure switching system which is controlled by said accelerator pedal so as to furnish a first electrical signal indicative of whether said engine is operating in the non-load bearing idling operational condition or in the load bearing non-idling operational condition;

said control system receiving said first electrical signal and also receiving supply of switched electrical power from said electrical switch as a second electrical signal;

said double action diaphragm actuator positioning said throttling valve to said first, second, or third position according to different combinations of supply of atmospheric pressure or vacuum to said first and second diaphragm chambers;

selective supply of atmospheric pressure or vacuum to said first diaphragm chamber being controlled by said first electromagnetic pressure switching valve which is controlled according to said first electrical signal, and selective supply of atmospheric pressure or vacuum to said second diaphragm chamber being controlled by said second electromagnetic pressure switching valve which is controlled according to said second electrical signal.

2. An intake air throttling system according to claim 12, wherein said double action diaphragm actuator positions said throttling valve to said first position when both said first diaphragm chamber and said second diaphragm chamber are supplied with vacuum; said double action diaphragm actuator positions said throttling valve to said second position when said first diaphragm chamber is supplied with vacuum and said second diaphragm chamber is supplied with atmospheric pressure; and said double action diaphragm actuator positions said throttling valve to said third position when both said first diaphragm chamber and said second diaphragm chamber are supplied with atmospheric pressure.

3. An intake air throttling system according to claim 2, wherein a negative pressure one way delay valve is incorporated between said first electromagnetic pressure switching valve and said first diaphragm chamber so as to delay transmission of vacuum from said first electromagnetic pressure switching valve to said first diaphragm chamber.

4. An intake air throttling system according to claim 3, wherein said second electromagnetic pressure switching valve is directly controlled by said electrical switch so that is supplies atmospheric pressure to said second diaphragm chamber when said electrical switch is closed and to supply vacuum to said second diaphragm chamber when said electrical switch is opened, and said first electromagnetic pressure switching valve is controlled by a series combination of said electrical switch and said switching system so that it supplies atmospheric pressure to said first diaphragm chamber when said electrical switch is closed and said accelerator pedal is pushed downwardly and to supply vacuum to said first diaphragm chamber when said electrical switch is opened or said accelerator pedal is released.

* * * * *